United States Patent [19]

Belbel et al.

[11] Patent Number: 4,638,275

[45] Date of Patent: Jan. 20, 1987

[54] ELECTRIC SWITCHING UNIT COMPRISING A GAS-TIGHT CASING FOR PROTECTION OF CONTACTS

[75] Inventors: Elie Belbel, Vaucresson; Robert Caudron, Meudon; Louis Fèchant, Le Vesinet; André Haury, Le Raincy; Michel Lauraire, Courbevoie; Jacques Muniesa, Boulogne Billancourt; Lucien Siffroi, Versailles, all of France

[73] Assignee: La Telemecanique Electrique, Nanterre, France

[21] Appl. No.: 714,928

[22] Filed: Mar. 22, 1985

[30] Foreign Application Priority Data

Mar. 28, 1984 [FR] France ..... 84 04826

[51] Int. Cl.[4] ..... H01H 1/66; H01H 51/00

[52] U.S. Cl. ..... 335/151; 335/154; 335/156; 200/146 AA

[58] Field of Search ..... 335/151, 154, 156, 131; 200/146 AA, 144 B

[56] References Cited

U.S. PATENT DOCUMENTS 2,444,198 6/1948 Hasselhorn .
2,794,087 5/1957 Jennings et al. ..... 200/144 B
2,886,669 5/1959 Kelto .
2,908,780 10/1959 Walters .
2,908,784 10/1959 Kuhn et al. ..... 335/131
3,154,655 10/1964 Hawkins ..... 200/144 B

FOREIGN PATENT DOCUMENTS 2284968 4/1976 France .
2119575 11/1983 United Kingdom .

*Primary Examiner*—E. A. Goldberg
*Assistant Examiner*—Lincoln D. Donovan
*Attorney, Agent, or Firm*—Young & Thompson

[57] ABSTRACT

An electric switching unit for preventing oxidation of copper-base contacts in contactors comprises a body (2), comprises an electromagnet (11) having a stationary yoke (7) and a moving armature (15) in cooperating relation with a plurality of switches (36). A protective casing (42) is fixed on the body so as to contain the switches. The contact-studs (30, 31, 32, 33) of the switches (36) essentially have a base of cuprous materials while a non-oxidizing atmosphere is confined and maintained beneath the protective casing (42) by seals (55, 23, 47). The seals are placed on the one hand between the moving armature (15) and a first face (21) of the body (2) and on the other hand between the casing (42) and a second face (41) of the body which is opposite to the first face.

13 Claims, 7 Drawing Figures

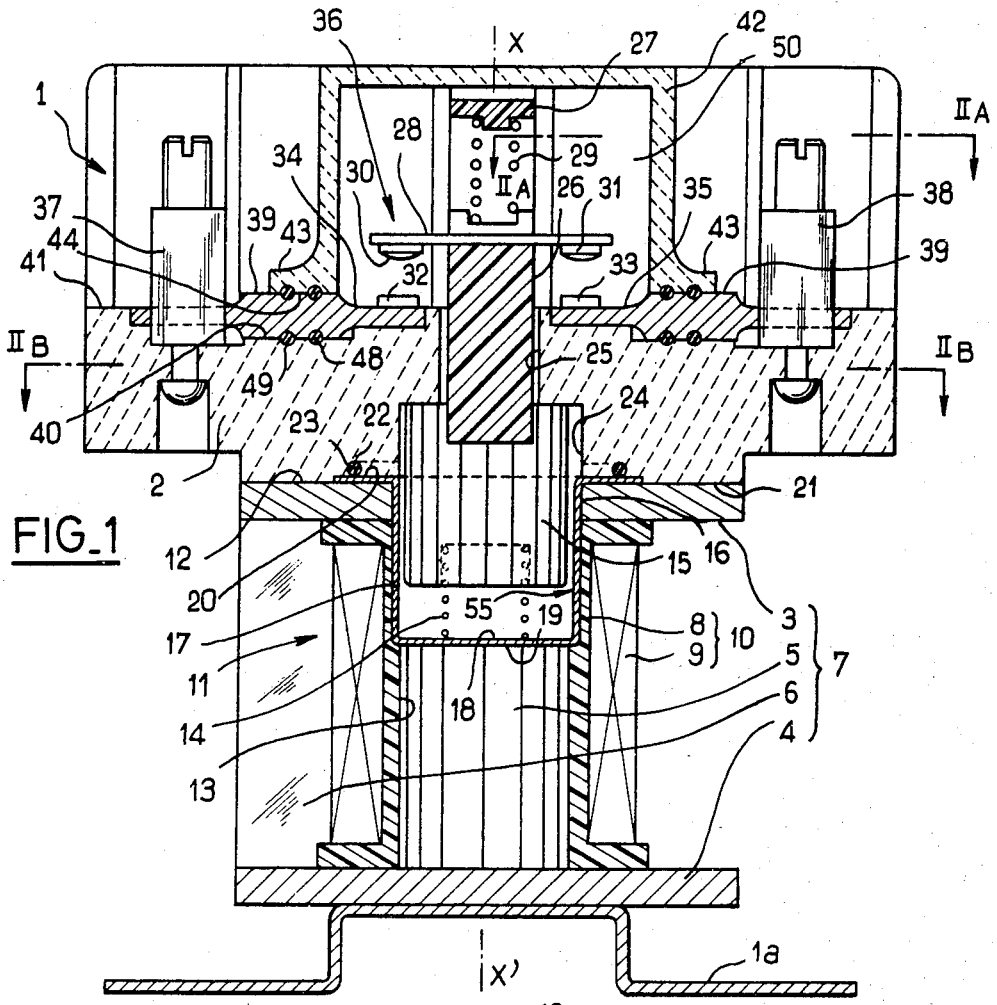
FIG_1
FIG_2
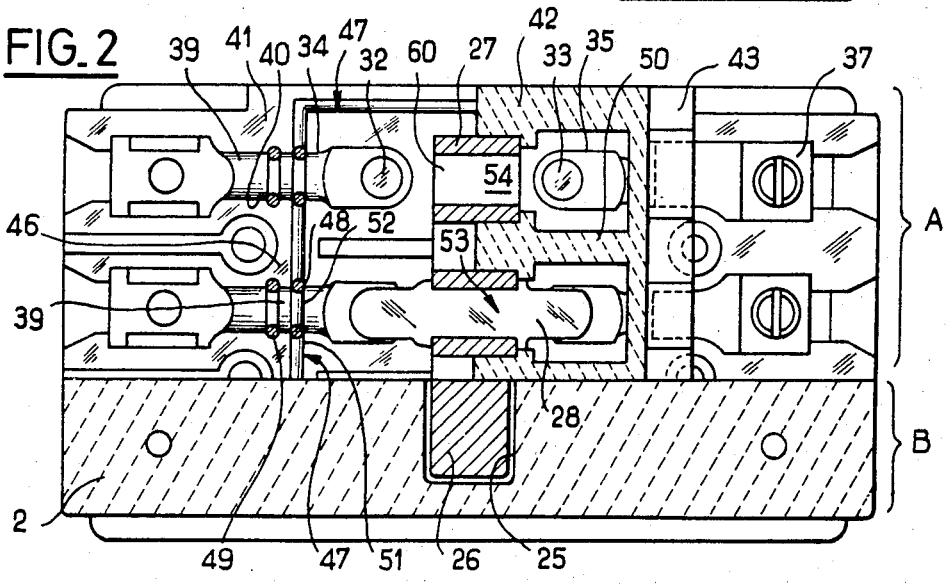

ELECTRIC SWITCHING UNIT COMPRISING A GAS-TIGHT CASING FOR PROTECTION OF CONTACTS

BACKGROUND OF THE INVENTION

1. Field of the Invention

The present invention relates to an electric switching unit of the type which comprises the following components:

a body, an electromagnet having a stationary yoke, a moving armature and a stationary excitation coil, said electromagnet being associated with said body by means of one of its stationary elements;

a plurality of switches each comprising a stationary contact member and a moving contact which are provided with contact-studs, the moving contacts being placed together with their pressure springs on an insulating contact-holder which is capable of displacement in sliding motion within said body in order to cause opening and closing of the switches and which is mechanically associated with said moving armature whilst the stationary contacts are rigidly fixed to the body;

a gas-tight protective casing which is fixed on the body so as to contain the switches and is provided with insulation with respect to said switches;

resilient means capable of placing the moving armature in a rest position in which it is located at a distance from the yoke.

2. Description of the Prior Art

Switching units of this type can be employed either when the environment in which they are placed has an aggressive character (acidity, humidity, dust particles) or else when it is desired to reduce the harmful and inevitable influence of oxygen on the contacts, even when the surrounding atmosphere is normal.

Other practical considerations may also entail the need to confine the switches in special atmospheres. Of primary interest here are the design objectives which potentially offer a reduction in equipment construction costs by dispensing with the use of silver in the contact-studs of these switches.

It is indeed well-known that the present widespread use of silver or silver alloys in contact-studs arises mainly from the fact that the oxides of this metal are not stable. Since these oxides decompose in the vicinity of 200° C., pure silver is commonly found in the contact region of studs in which it is employed, with the result that their use and operation in an oxidizing atmosphere is accordingly justified.

SUMMARY OF THE INVENTION

The invention proposes to provide an electric switching unit of the aforementioned type in which the materials used for the contact-studs of the switches no longer contain silver and in which inexpensive means are provided for maintaining a surrounding atmosphere which has non-aggressive properties in regard to the materials chosen.

In accordance with the invention, the switching unit is distinguished by the fact that the contact-studs of the switches essentially have a base of cuprous materials whilst the confined atmosphere beneath the protective casing has a non-oxidizing character and retains this character by virtue of sealing means of special shape which are placed on the one hand between the moving armature and a first face of the body and on the other hand between the protective casing and a second body face opposite to the first.

Said sealing means thus permit the use of contact-studs formed of cuprous materials which are distinctly less costly than silver and silver alloys.

BRIEF DESCRIPTION OF THE DRAWINGS

Other features of the invention will be more apparent upon consideration of the following description and accompanying drawings, wherein:

FIG. 1 is a view in elevation showing a first electric switching unit in accordance with the invention, this view being taken in cross-section along a plane of symmetry which passes through the axis of the coil of its electromagnet;

FIG. 2 shows the top of the switching unit with the casing removed in the left-hand half-view whilst portion A of the right-hand half-view is a cross-section taken along the plane IIA—IIA of FIG. 1 and portion B is a sectional view taken along the plane IIB—IIB of FIG. 1;

DESCRIPTION OF THE PREFERRED EMBODIMENTS

Figure 3:
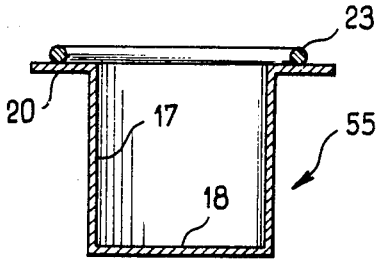
FIG. 3 is a longitudinal sectional view of the cylindrical sealing cup.

In the embodiment of FIG. 1, the switching unit 1 comprises a body 2 of electrically insulating material having a generally parallelepipedal shape and a bottom face 21 beneath which is mounted an electromagnet 11. Said electromagnet is constituted by a fixed magnetizable yoke 7 formed by the association of the magnetizable members 3, 4, 5, 6, an excitation coil 10 comprising a coil form 8 having a bore 13 and a winding 9, and a magnetizable moving armature or core 15, preferably of cylindrical shape. Said core is subjected to the action of a restoring spring 14 for placing it in a rest position which is visible in FIG. 1. A support bracket **1*a* is secured to the magnetizable member 4** for attaching the switching unit to a frame.

The magnetizable member 3 which is fixed beneath the body 2 has an opening 16 through which is passed the cylindrical portion 17 of a non-magnetic cup 55 which is formed of brass, for example, and serves as a housing both for the core 15 and for the spring 14. The bottom wall 18 of said cup is placed in the immediate vicinity of the top surface 19 of the magnetizable member 5 and preferably against said top surface. Said bottom wall serves at the same time as an anti-remanence air-gap of the electromagnet. The top edge of said cup 55 has an outward extension in the form of a flat annular flange 20 (as also shown in FIGS. 1 and 3) which rests on the top surface 12 of the member 3 and which is applied by this latter against the bottom surface 21 of the body 2.

In said bottom surface 21 is cut a channel 22 in which is fitted an elastic seal 23 such as an O-ring seal, for example. Said seal is compressed by the annular flange 20 when the member 3 is secured against the bottom surface 21 of the body 2 by means such as screws (not shown in the drawings). A gas-tight seal is consequently established between the body 2 and the internal space of the cup 55.

A recess 24 which serves as a stop for the core 15 is located in the body 2, in the line of extension of the cup 55 and coaxially with the axis X—X' of said cup. Said recess opens into an axial passage 25 which extends through the body 2. An insulating contact-holder 26 is mounted within said passage and extends above the body 2 so as to carry a plurality of parallel arms corresponding in number to the switches placed above said body 2.

Each arm such as the arm designated by the reference 27 (as shown in FIG. 2) has a window 60 in which is placed a contact bridge 28 and a contact pressure spring 29 (shown in FIG. 1) which urges said contact bridge towards the core 15 against the bottom of said window 60.

The contact-studs 30, 31 of said contact bridge 28 are formed of a cuprous material or alloy, examples of which include the following: CuMeO, CuCd or Cu/C (Me=metal; C=graphite). The same also applies to the contact-studs 32, 33 which form part of two stationary contact members 34, 35 which are placed beneath the bridge 28.

Said stationary contact members 34, 35 which form together with the movable bridge 28 a switch designated by the reference 36 are each connected at the opposite end to a connecting terminal 37, 38 respectively.

Figure 6:
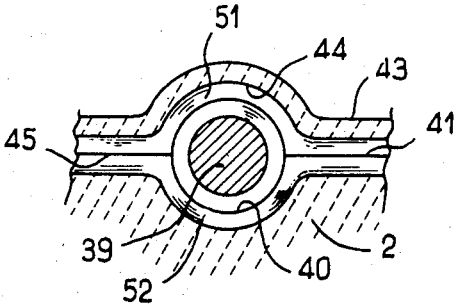
FIG. 6 is a sectional view showing the complementary half-housings formed within the protective casing and within the body.

Between the terminal 37 or 38 and the contact-stud 32 or 33, each stationary contact member 34 or 35 has a cylindrical intermediate portion such as the portion 39 which fits within a cylindrical cavity or half-housing as designated by the reference 40 and formed in the top surface 41 of the body 2 (as shown in FIG. 6).

A protective casing 42 which is electrically insulated from the stationary contact members and formed of non-porous electrically insulating material such as, for example, ceramic material, a polymer or else a metallic material coated either entirely or partly with a layer of electrically insulating material such as, for example, ceramic material or a suitable polymer at local temperatures and conditions is removably fitted over the complete set of switches such as the switch 36 and is fixed on the top surface 41 of the body 2 by means such as screws (not shown in the drawings).

Figure 5:
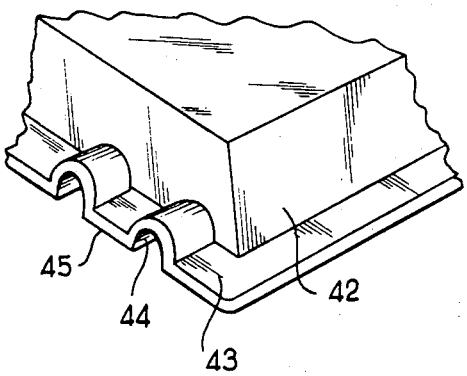
FIG. 5 is a fragmentary view in perspective showing the protective casing.

The edge of said protective casing 42 which is adjacent to the top surface 41 of the body is provided with a flat peripheral flange 43 at right angles to the side walls of the casing. Said peripheral flange 43 is provided with a number of cylindrical cavities or half-housings such as those designated by the reference 44 (and shown in FIG. 5) which are placed opposite to the cylindrical half-housings 40 so as to form, when the casing 42 is mounted on the body 2, a complete housing which receives the intermediate cylindrical portions 39 of the contact members 34, 35 (as shown in FIG. 6).

Between all of these half-housings 40, 44 are located flat surface portions 45 of the flange 43 of the protective casing which cooperate with corresponding flat surface portions 46 of the top surface 41 of the body 2. In order to establish a high standard of gas-tightness between these surfaces, a closed-loop gasket 47 of generally rectangular shape is fitted between the protective casing 42 and the body 2 (as shown in FIG. 4).

Said gasket 47 is molded in a single piece from elastomer material and is provided with toric portions such as those designated by the reference 48 which are perpendicular to the rectangular loop of the gasket. The number of said toric portions corresponds to the number of stationary contact members 34, 35 with which the switching unit is provided, the intermediate portions 39 of said stationary contact members being inserted in said toric portions 48.

Said gasket 47 is advantageously fitted in channels such as those designated by the references 51, 52 (as shown in FIG. 6) and formed both on the flat surface portions 45 of the flange 43 of the protective casing 42 and in the cavities 40 of the top surface 41 of the body 2 in order to be subjected to measured compression when the protective casing 42 is mounted on the body 2.

Figure 4:
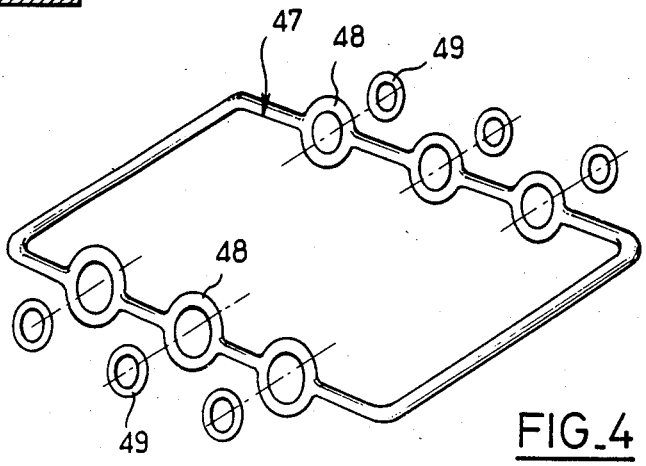
FIG. 4 is a view in perspective showing the sealing gasket and O-ring seals of the protective casing.

O-ring seals of a special type such as those designated by the reference 49 (as shown in FIG. 4) can also be placed within the half-housings 40, 44 around intermediate cylindrical portions 39 of the stationary contact members in order to permit compression at the time of assembly (in the same manner as the gasket 47) and thus to achieve total gas-tightness.

The protective casing 42 which advantageously has internal insulating partitions such as the partition 50 (as shown in FIG. 2) for providing a separation between two adjacent switches 54, 53 can be filled with a special atmosphere by means of one or a number of orifices which can be shut-off but are not shown in the drawings.

The atmosphere considered can be either a vacuum or a mixture in any desired proportion of non-oxidizing gases such as $N_2$, $H_2$, Ar, He, or else an atmosphere containing electronegative and dielectric gases such as $SF_6$, $CF_4$, $CCl_4$ or a mixture of these latter with non-oxidizing gases.

The body 2 can be formed either of plastic material or of ceramic material. The surfaces which are intended to cooperate with the seals 47, 49 will advantageously be machined and in particular ground after molding.

Figure 7:
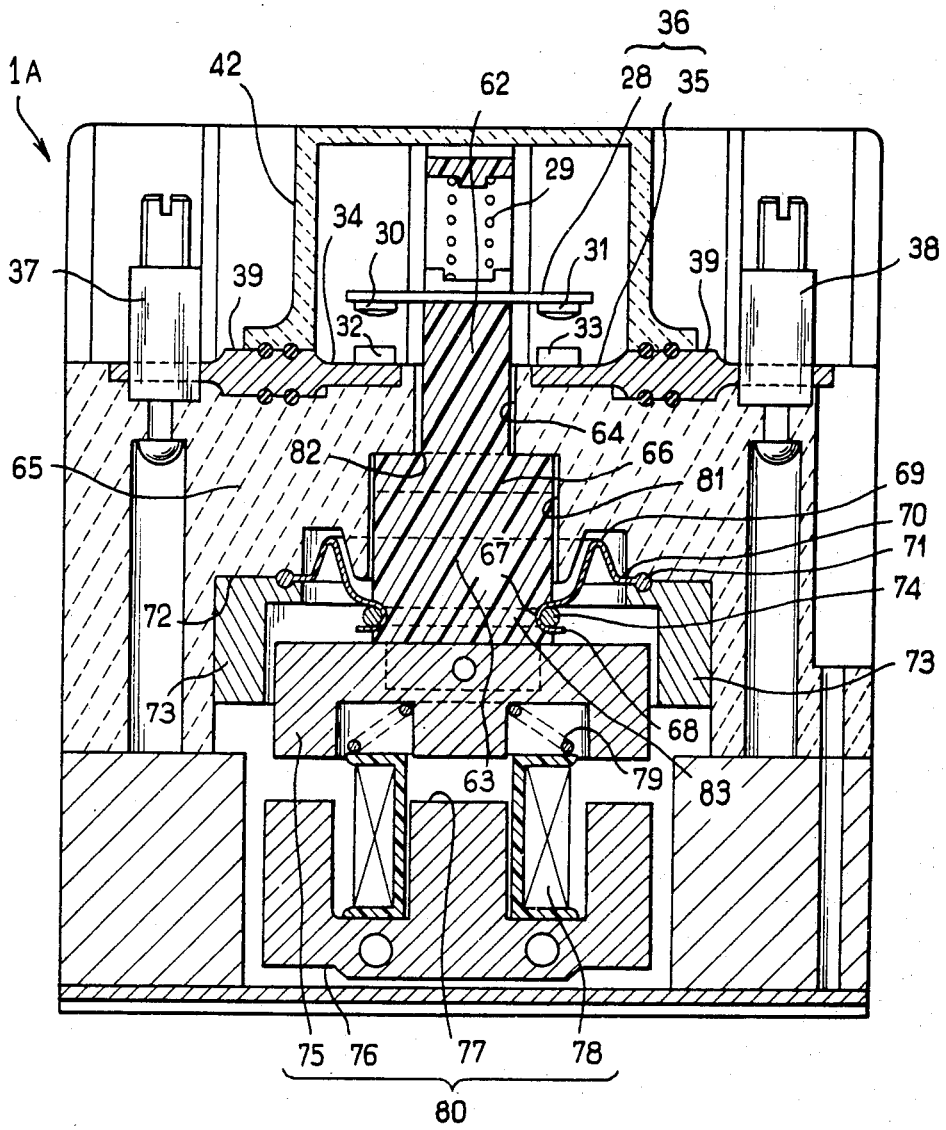
FIG. 7 is a longitudinal sectional view of a second embodiment of the switching unit in accordance with the invention, the upper portion of said unit being identical with the upper portion of the first embodiment.

In the second embodiment illustrated in FIG. 7, the switching unit 1A comprises a protective casing 42, switches and a top body surface which are identical with those of the switching unit shown in FIGS. 1 to 6. These parts are therefore designated by the same references. The electromagnet and the contact-holder of the switching unit 1A are different.

In the same manner as the contact-holder of the switching unit 1 shown in FIGS. 1 and 2, the contact-holder 82 shown in FIG. 7 has parallel arms 62 each adapted to carry a contact bridge 28. Said arms 62 pass through passages such as those designated by the reference 64 and are joined to each other by means of a cross-piece 66 placed within a recess 81 into which said passages open, said recess being provided with an extension 63 which projects beyond said recess.

An intermediate region 83 of said extension is provided in its external surface with a groove 67 which is advantageously annular and is adapted to receive the inner peripheral portion 68 of a deformable cuff 69 formed of elastomer material. Said inner peripheral portion is preferably maintained within said groove 67 by means of a clamping ring 74. The outer peripheral portion 70 of said deformable cuff 69 has a beaded edge 71 which is clamped between a bottom surface 72 of the body 65 and a flanged collar 73 which surround said cuff. By way of example, said flanged collar 73 is fixed on the bottom face 72 of the body 65. The deformable cuff 69 consequently establishes a gas-tight seal between the body 65 and the contact-holder, with the result that the switches such as those designated by the reference 36 are placed within an enclosed space which is totally leak-tight with respect to the exterior and in which a non-oxidizing atmosphere is continuously maintained. The contact-studs 30, 31, 32, 33 can thus be constructed of copper-base materials which are much less costly than silver.

The electromagnet 80 employed in this switching unit comprises a moving armature 75 which is rigidly fixed to the extension 63 and cooperates with an E-shaped yoke 76, the central arm 77 of which is surrounded by an excitation coil 78. A restoring spring 79 sets the armature 75 and therefore the contact-holder 62 in the rest position, the yoke 76 being rigidly fixed to the body 65 either directly or indirectly.

In this second embodiment, the electromagnet 80 is therefore entirely outside the volume contained between the protective casing 42 and the deformable cuff 69 and can be supplied directly from an alternating-current source since, at their level, the presence of phase-shift rings calls for zero air-gaps between the flat surface-ground portions of the moving armature 75 and of the yoke 76.

As will readily be apparent, the invention is not limited to the examples described in the foregoing and any number of modifications may accordingly be contemplated without thereby departing either from the scope or the spirit of the invention.

What is claimed is:

1. An electric switching unit comprising:

a body (2, 65), an electromagnet (11, 80) having a stationary yoke (7, 76), a moving armature (15, 75) and a stationary excitation coil (10, 78), said electromagnet being rigidly fixed to said body through one of its stationary elements (7, 76), a plurality of switches (36) each comprising a stationary contact member (34, 35) and a moving contact (28) which are provided with contact-studs (30, 31, 32, 33), the moving contacts being urged by pressure springs toward a closed position, said springs and contacts being mounted on an insulating contact-holder (26, 62) which is capable of displacement in sliding motion within said body in order to cause opening and closing of said switches and which is mechanically associated with said moving armature whilst the stationary contacts are rigidly fixed to said body, a gas-tight protective casing (42) which is fixed on the body so as to contain the switches and is provided with insulation with respect to said switches, resilient means (14, 79) capable of placing said moving armature (15, 75) in a rest position in which said armature is located at a distance from said yoke (7, 76), wherein the contact-studs (30, 31, 32, 33) of the switches (36) are made of cuprous material whilst the protective casing (42) is filled with a non-oxidizing medium and sealed by sealing means (23, 55, 69, 47) which are placed on the one hand between the moving armature (15, 75) and a first face (21, 72) of the body (2, 65) and on the other hand between the protective casing (42) and a second face (41) of the body which is opposite to the first face.

2. A switching unit according to claim 1, wherein the stationary contact members (34, 35) have a cylindrical portion (39) located between the terminal (37) and the contact-stud (32) which is engaged partially within a cylindrical half-housing (40) formed in the second face (41) of the body and partially within a complementary cylindrical half-housing (44) formed on a peripheral flange (43) of the protective casing (42) which is adjacent to said second face.

3. A switching unit according to claim 2, wherein a general gasket (47) molded in one piece surrounds the cylindrical portions (39) locally and extends between said portions along said second face (41) and said flange (43) of the protective casing.

4. A switching unit according to claim 3, wherein the gasket (47) forms a closed loop having a generally rectangular shape and is provided with toric portions (48) perpendicular to the loop formed by the gasket, said toric portions being adapted to surround the cylindrical portion (39) of each stationary contact member (34, 35) and being surrounded and compressed by the half-housings (40, 44).

5. A switching unit according to claim 4, wherein an O-ring seal (49) is placed around the cylindrical portion (39) of each stationary contact member and in the vicinity of the gasket (47) in order to be surrounded and compressed by the half-housings (40, 44).

6. A switching unit according to claim 5, wherein the protective casing (42) is provided internally with partitions (50) for isolating two adjacent switches (53, 54).

7. A switching unit according to claim 6, wherein the protective casing (42) is formed of ceramic or polymer material or is formed of metal and covered with these materials.

8. A switching unit according to claim 7, wherein the protective casing (42) contains an atmosphere composed at least partially of a non-oxidizing gas such as nitrogen, hydrogen, argon or helium.

9. A switching unit according to claim 7, wherein the protective casing (42) contains an atmosphere composed at least partially of an electronegative gas such as sulfur hexafluoride.

10. A switching unit according to claim 9, wherein the first face (21) of the body (2) is fitted with a seal (23) applied against an annular flange (20) formed on a non-magnetizable cylindrical cup (55) which penetrates into the bore (13) of the coil form (8) of the coil (10) and which contains an armature in the form of a plunger-core (15) connected to a contact-holder (26) which extends through a passage (24, 25) of the body (2).

11. A switching unit according to claim 9, wherein the annular flange (20) is applied against the first face (21) and against the seal (23) by a stationary yoke member (3) which surrounds the cup (55).

12. A switching unit according to claim 9, wherein the first face (72) of the body (65) is adapted to cooperate with a first fixed end (70) of a deformable cuff (69) having a second and movable end (68) applied against the periphery (67) of an extension (63, 83) of the contact-holder (82) which is remote from the switches (36) and which is coupled mechanically to the moving armature (75) of the electromagnet (80).

13. A switching unit according to claim 12, wherein the first end (70) of the deformable cuff (69) has a beaded edge (71) applied against the first face (72) by a flanged collar (73) which is fixed on the body (65).

* * * * *